US008196984B2

(12) United States Patent
Haushalter

(10) Patent No.: US 8,196,984 B2
(45) Date of Patent: Jun. 12, 2012

(54) APPARATUS FOR REMOVING EARRINGS FROM A PURCHASE CARD

(76) Inventor: Alexa Lea Haushalter, Bellefontaine, OH (US)

( * ) Notice: Subject to any disclaimer, the term of this patent is extended or adjusted under 35 U.S.C. 154(b) by 0 days.

(21) Appl. No.: 12/927,335

(22) Filed: Nov. 12, 2010

(65) Prior Publication Data

US 2011/0061218 A1 Mar. 17, 2011

Related U.S. Application Data

(63) Continuation-in-part of application No. 11/825,083, filed on Jul. 3, 2007, now abandoned.

(51) Int. Cl.
*B25B 9/02* (2006.01)

(52) U.S. Cl. ..... 294/99.2; 294/3; 294/219

(58) Field of Classification Search ..... 81/3.36, 81/3.39, 3.55, 3.56; 294/5, 99.2, 3, 217, 294/219; 30/137, 150
See application file for complete search history.

(56) References Cited

U.S. PATENT DOCUMENTS

| | | | | | |
|---|---|---|---|---|---|
| 2,818,866 | A * | 1/1958 | Thomas | 606/148 |
| 3,901,243 | A * | 8/1975 | Read | 606/188 |
| 5,098,137 | A * | 3/1992 | Wardall | 289/17 |
| 5,263,968 | A * | 11/1993 | Sorensen | 606/207 |
| 5,593,189 | A * | 1/1997 | Little | 289/17 |
| D401,486 | S * | 11/1998 | Becker | D8/19 |
| 2006/0244275 | A1 * | 11/2006 | Bases | 294/3 |

* cited by examiner

*Primary Examiner* — Dean Kramer
(74) *Attorney, Agent, or Firm* — Barbara Joan Haushalter

(57) ABSTRACT

An apparatus for removing earrings from a display card includes a pronged mechanism for slipping between the ornamental portion of the earring and the card. A user applies leverage to the pronged mechanism to separate the earring from the card. The pronged mechanism can be enhanced with a cover for preventing the earring from flipping away as it is removed from the card. The cover can be attached to the pronged portion using any suitable resources, such as a band, adhesive or hinge. When the pronged mechanism removes the earring from the card, the earring retainer on the back of the earring necessarily also separates from the card, so the device can be further enhanced with a cup for catching and containing the earring retainer. The apparatus can be a single, integrated device, and is of a sufficiently diminutive size to avoid unwieldiness of use and to prevent damage to the earring itself.

11 Claims, 4 Drawing Sheets

APPARATUS FOR REMOVING EARRINGS FROM A PURCHASE CARD

RELATED APPLICATIONS

This application is a continuation-in-part of copending application Ser. No. 11/825,083, filed Jul. 3, 2007, by the present inventor, and totally incorporated herein by reference.

BACKGROUND OF THE INVENTION

The present invention relates to an earring removal apparatus and, more particularly, to a tool for removing earrings from the display cards that earrings are typically attached to when a customer purchases new earrings.

Throughout the years of recorded history, men and women have been eager to possess and use ornamental jewelry about their clothing and person. Earrings in particular have been used by both sexes, and still are for reasons that are both varied and ornamental. As a result of the attractiveness of the use of earrings, many people, particularly women, make fairly frequent purchases of earrings for the pleasure of variety.

Earrings for pierced ears are, perhaps, the more popular form of earrings worn currently, typically by women, but also by men. Such earrings include an exposed ornamental design which may include a precious stone or metal, and a post or thin elongated shaft extending therefrom. The post is inserted through a previously pierced hole in the ear lobe and, thereafter, held in position in the ear by a retainer which is slid onto the post behind the ear lobe. Most individuals who wear jewelry of this type gradually acquire a collection of different styles and designs of pierced earrings. Sometimes, the purchaser will remove the earrings from the display card as soon as the earrings are purchased, but earrings purchased for a special occasion may be saved on the purchase card until the occasion to wear them arises.

Typically, the purchaser uses their fingers, particularly their fingernails, to grasp the front and back of the earring, and remove same from the purchase card. If earrings have been saved on the display card until the special occasion for wearing the earrings arrives, the purchaser may be completely primped and ready, save for the removal of the earrings from the card. Unfortunately, this activity often nicks or damages ones fingernails. Although a nicked fingernail can be filed back to shape, if the purchaser has a manicure, the damage to the manicure is not easily repaired.

Manicures are part of our popular culture. In fact, one quarter of all American women have regular professional manicures, and even 4 percent of men say they have regular professional manicures. And fully half of American women give manicures to themselves. From a worldwide survey of fourteen hundred people by TripAdvisor asking for their opinions on flying, manicures was one of the top five luxuries travelers would pay extra for. Considering that some salons charge upwards of $75 for a full manicure, this is an investment most people want to protect.

Furthermore, when a user is trying to remove an earring from a purchase card, the earring itself may be damaged if a user is pulling on twisting the parts in an attempt to separate the earring from the purchase card. If one is also trying to preserve a manicure, even more laborious twisting or manual tugging of the parts may occur, actions which do not have a controlled motion, putting ornamentation of the earring itself at risk. For instance, a gem may come off a decorative earring or a delicate filigree might be bent or broken, as the user attempts to extract the earring from the card and also preserve a manicure.

In the prior art, U.S. Pat. No. 5,263,968, to Sorensen, discloses an apparatus for removing a piercing stud clasp. Specifically, the apparatus requires that it be inserted into the stud clasp, and is expressly for use in removing the clasp while leaving the stud in the ear. This prevents the user from having to re-insert the stud, pushing around in the fatty tissue of the ear lobe to find the opening, which is particularly the case when the piercing is fresh. The Sorensen apparatus is particularly suited, then, for a situation where one is to leave an earring in an ear during a healing period, but one would like to remove the stud to clean and disinfect the stud and the area around the healing lobe—without actually removing the earring. Hence, prongs are proposed to be applied perpendicular to the clasp opening, into the retainer.

There are several inherent disadvantages of the Sorensen apparatus when considering the needs of some earring wearers to remove the earrings from a purchase card without damaging either the earring or a manicure. The Sorensen approach does not address the gentle levering action that might be required to preserve both the ornamental embellishments of an earring and a manicure, since the Sorensen apparatus is applied at the back of the ear, to the stud, rather than to the decorative earring part. The Sorensen apparatus further discloses and claims an action like that of a pair of tongs, whereby as the prongs are fitted perpendicularly into the clasp openings, an opposing force is applied to the end of the protruding stud to push the stud out of the locked position. Even then, the earring is still not separated from the ear, nor would it be separated from a purchase card. At this point in the Sorensen disclosure, if one were to desire to remove the earring from ones ear (or from a purchase card), the disassembly is completed using ones fingers, which, again, could damage ones manicure.

It would be desirable, then, to have a means for removing earrings from a display card which avoids nicking and scratching of ones fingernails and manicure, and is also gentler on the parts of the earring than merely pulling the earring off the card with manual tugging or force. It would also be desirable to have a means for removing an earring from an earring card, whereby the means utilizes a controlled motion or leverage. It would be particularly desirable to be able to controllably detach earrings from a display card while protecting ones manicure, and while protecting delicateness and embellishments of the earring.

SUMMARY OF THE INVENTION

This need is met by the earring extractor apparatus according to the present invention, wherein the apparatus is particularly suitable for detaching earrings from a purchase card without damaging either ones manicure or the earring itself. It is an advantage of the present invention that nicking and scratching of ones fingernails and manicure, while detaching earrings from a display card, is prevented. It is a further advantage that damage to embellishments on the earring are also avoided by using the petite and delicate tool of the present invention.

In accordance with one aspect of the present invention, an apparatus for removing earrings from a display card comprises a pronged mechanism for slipping between the earring and the card. Due to the typically delicate and often diminutive nature of most earrings, it is a particular aspect of the present invention that the apparatus is correspondingly diminutive to achieve the task at hand. Specifically, the earring extractor apparatus, rather than being much too large a tool for the job, is proportional to its intended use. This is particularly the situation in most instances, as it is likely and intended to be used by the more delicate, manicured, hands of a female. Making the apparatus correspondingly diminutive, as compared with the typical earring, allows the user to easily hold and maneuver the apparatus as she slides the pronged mechanism between the earring and the card. The pronged mechanism can be enhanced with a cover for preventing the earring from flipping away as it is removed from the card. The cover can be attached to the pronged portion by any suitable means, such as a band, adhesive, or other means.

The earring comprises a front, ornamental portion, with a post extending therefrom. A retainer is insertable on the post to retain the earring on the purchase card, and later to retain the earring on the ear of the wearer. When the pronged mechanism removes the earring from the card, the earring retainer also necessarily separates from the card, so the device can be further enhanced with a cup means for catching and containing the earring retainer. Finally, the pronged mechanism, handle, cover and cover attachment means, and cup means can all be connected with a connector means, whereby the device becomes a single, integrated tool. The connector means preferably comprises means for securing the handle, which is attached to the pronged portion and cover, to the cup. Hence, the cup can be associated with an extension means approximately the length of the handle, so the handle and the extension means reach the connector means, resulting in an integrated device.

Accordingly, it is an object of the present invention to provide an earring extractor for removing earrings from a display card without incurring damage to ones fingernails or manicure. The earring extractor is particularly suited for use with pierced earrings. Other objects and advantages of the invention will be apparent from the following description, the accompanying drawings and the appended claims.

DETAILED DESCRIPTION OF THE PREFERRED EMBODIMENTS

Figure 1:
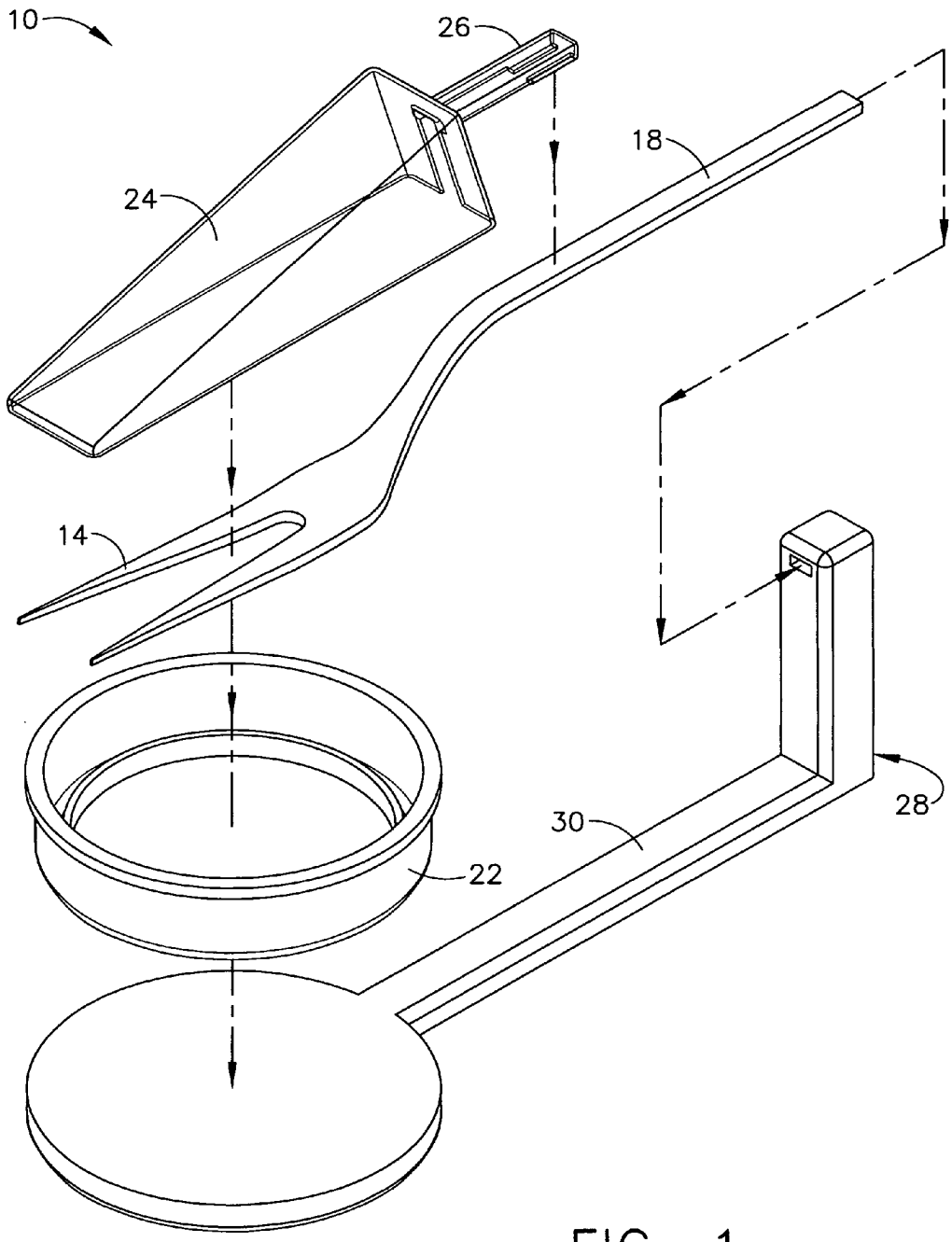
FIG. 1 is an exploded view of the earring extractor in accordance with the present invention.
Figure 2:
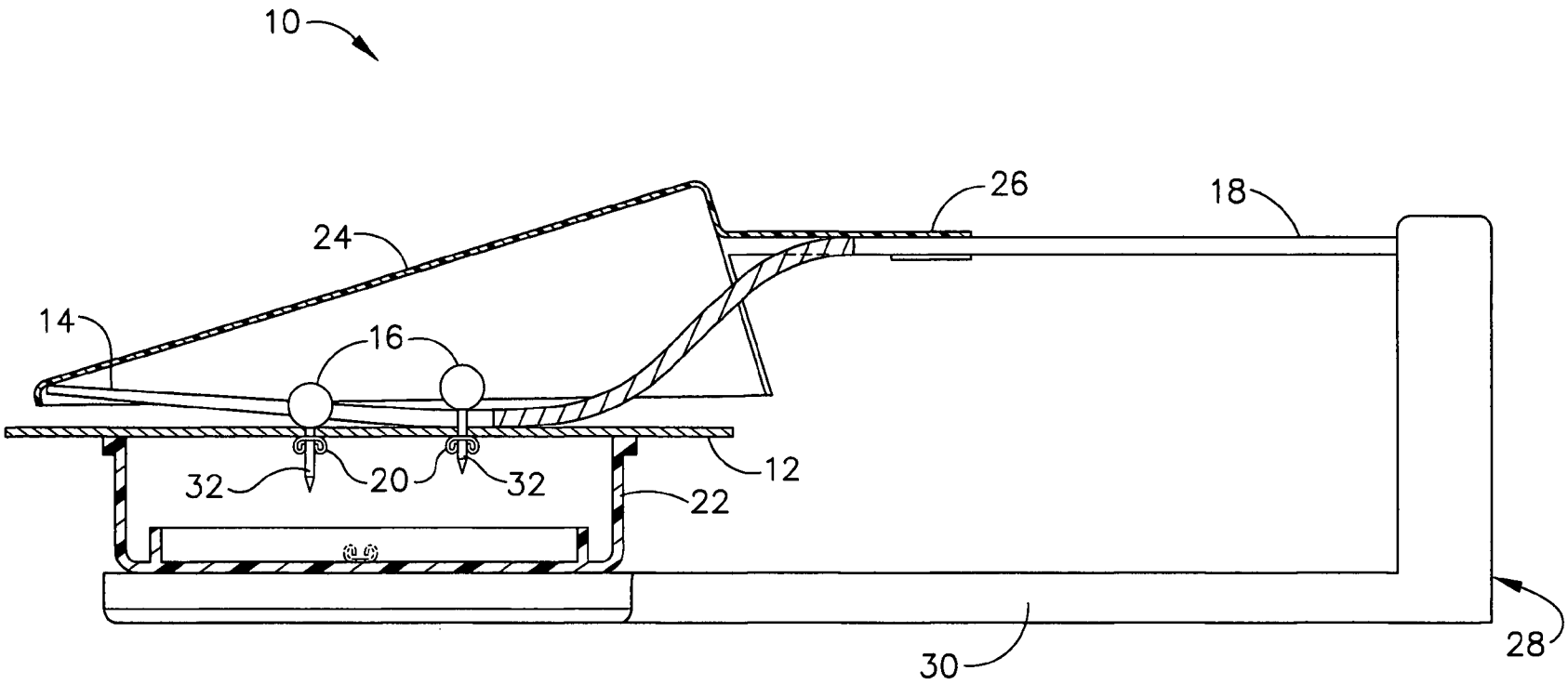
FIG. 2 is a view of the apparatus of the present invention being used for its intended purpose of removing earrings from an earring display card.

Referring to the drawings, in FIG. 1, there is illustrated an earring extractor apparatus 10 according to the present invention. The apparatus illustrated in FIG. 1 is particularly adaptable for removing pierced earrings from a display or purchase card 12, as illustrated in FIG. 2. The present invention is illustrated for use on earrings having an ornamental portion 16 with a post 32 extending therefrom, and an earring retainer 20 insertable on the post 32 to hold the earring to the card 12 or to an ear. The card 12 is situated between the ornamental portion 16 and the earring retainer 20. Besides offering an easy means for detaching earrings from a purchase card, the apparatus 10 is useful in that the removal of the earring from the card can be accomplished without nicking ones fingernails, or otherwise damaging ones manicure.

Continuing with FIGS. 1 and 2, the apparatus 10 comprises a pronged mechanism 14 for slipping between the ornamental portion 16 of the earring and the card 12. The pronged mechanism 14 has a pair of associated prongs which converge at a point whereby an associated handle 18 allows the user to hold the apparatus as he or she slides the pronged mechanism 14 between the earring ornament 16 and the card 12. Once the pronged mechanism is correctly located with reference to the earring and the display card, leverage can be applied upward to remove the ornamental portion 16 of the earring from the card 12. As the earring separates from the card, the earring retainer 20, insertable on the post 32 extending from the ornamental portion 16 of the earring, also separates from the card 12, on the back side of the card. Hence, in a preferred embodiment of the present invention, the apparatus 10 further comprises a cup means 22 for catching and containing the earring retainer 20.

Figure 3:
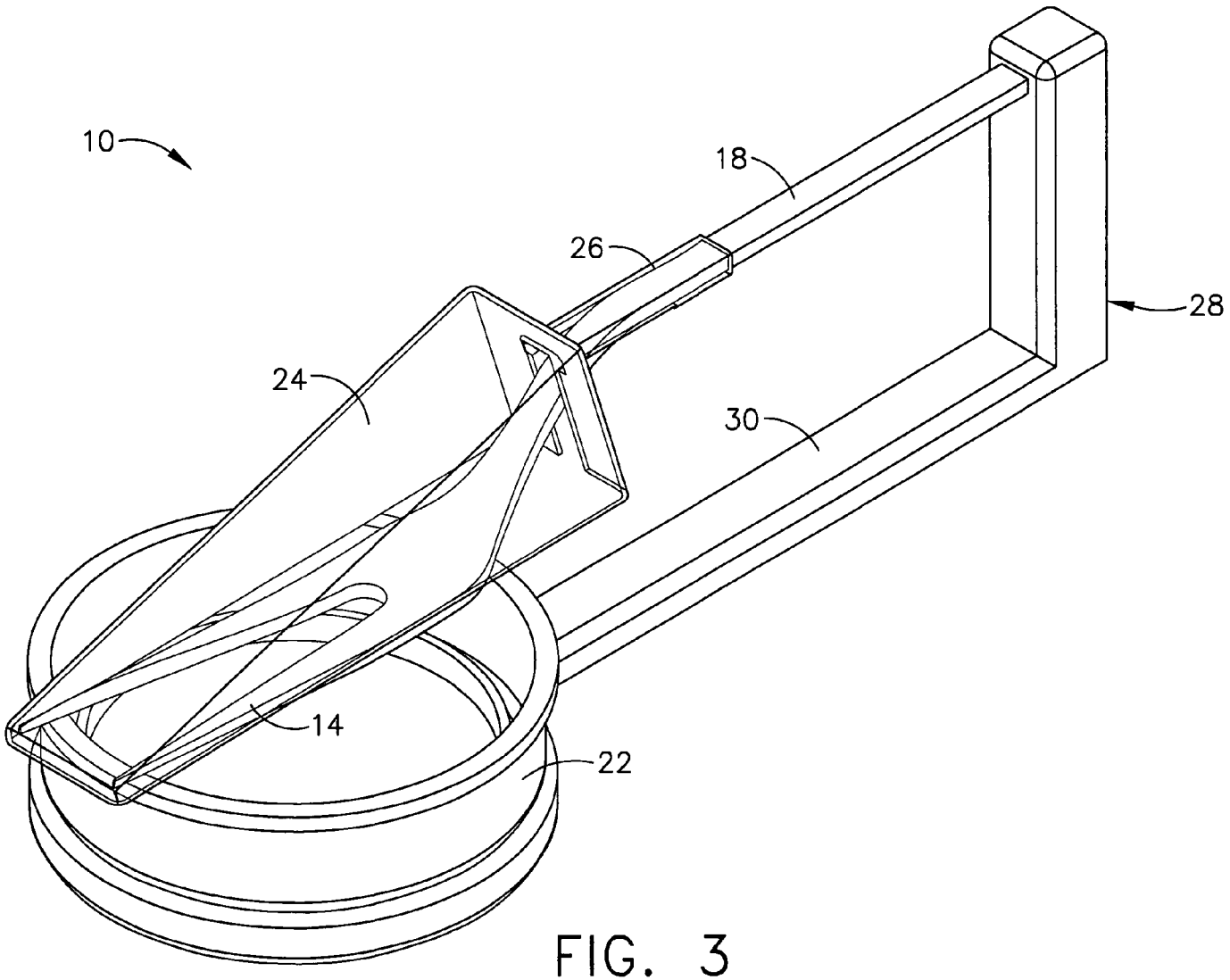
FIG. 3 is a side view of a preferred embodiment of the present invention.

Referring now to FIG. 3, and continuing with FIGS. 1 and 2, the pronged mechanism 14 can further be enhanced with a cover 24 for preventing the ornamental portion 16 of the earring from flipping away when sufficient leverage is applied to remove it from the card. The cover 24 can be attached to the pronged portion 14 by any suitable means 26, such as a band, an adhesive, a hinge, or any other like means. Furthermore, in one embodiment of the present invention, the pronged mechanism 14, handle 18, cover 24 and cover attachment means 26, and cup means 22 can all be connected with a connector means 28, whereby the device 10 becomes a single, integrated tool. The connector means 28 associates the handle 18, which is attached to the pronged portion 14 and cover 24, to the cup 22. Hence, the cup 22 can be associated with an extension means 30 approximately the length of the handle 18, so that the handle and extension means meet at the common region of the connector means 28, resulting in an integrated device.

Figure 4:
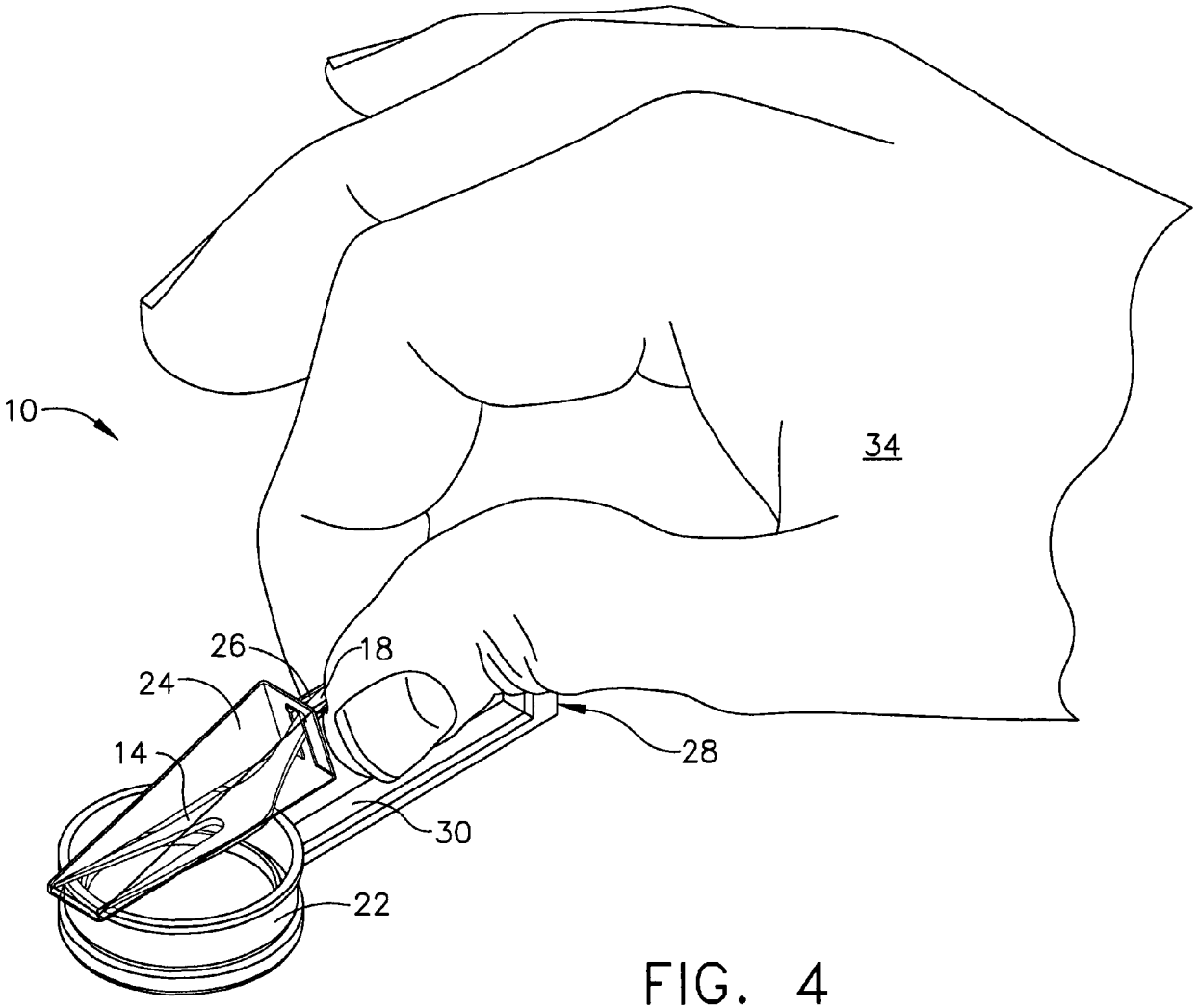
FIG. 4 is a view illustrating the distinctive diminutive size of the apparatus, as the user prepares to use the apparatus for its defined purpose.

As illustrated in FIG. 4, and referring still to FIGS. 1-3, the apparatus for removing earrings from a purchase card is necessarily of a diminutive size so as to be able to fit in the tight space between the earring and the card. A larger tool than that shown and described herein would quite probably damage the earring itself, defeating the whole purpose of protecting both one's manicure and one's jewelry, even if one were to manipulate and force a larger apparatus into attempting to accomplish the task required of the apparatus of the present invention. It is an aspect of the present invention that there is a close enough relation between the prongs to be able to slide the tiny earring retainer off the delicate earring post, and preserve the ornamental beauty of the earring itself.

Referring to FIGS. 1 and 4, the apparatus will operate most effectively if the prongs comprising pronged mechanism 14 are sufficiently near in proximity, one to the other, so as to slide between the earring and the card. In a preferred embodiment of the present invention, the entire apparatus 10, including any and all additional means, does not exceed 12 centimeters in length, and fits easily within a hand 34 of a user. It is further recommended that the space between the prongs comprising pronged mechanism 14 is not greater than 0.5 centimeters at its narrowest point, just before the prongs converge and merge, in a preferred embodiment, into the handle. Such an apparatus, as described herein and illustrated in the drawings, is comparable in efficacy to one's fingernails, allowing for controlled load force and effort force by the user when leverage is applied.

The pronged portion must be sufficiently diminutive to be able to slip between the earring and the card and separate the earring retainer from the earring post. Only a diminutive tool will operate properly on the typically petite and dainty parts of the earring. Only a diminutive, or miniature structured apparatus, could perform the stated function of safely removing the earring from the purchase card.

Having described the invention in detail and by reference to the preferred embodiment thereof, it will be apparent that other modifications and variations are possible without departing from the scope of the invention defined in the appended claims.

What is claimed is:

1. An apparatus for removing earrings from a purchase display card, the earrings including an ornamental portion with a predeterminedly narrow post extending therefrom, the narrowness of the post being of a universally standard size for fitting through a universally standard ear piercing, and an earring retainer insertable on the post to hold the earring to the card, the retainer also serving the purpose of holding the earring to the ear and being thereby smaller than the back of a normal earlobe, the card being situated between the ornamental portion and the earring retainer, the post extending through the purchase card, the apparatus comprising:

a pronged mechanism wherein associated prongs define a space measuring less than 0.5 centimeters, so as to slide between the earring and the card;

an associated handle for a user to apply leverage to the pronged mechanism, said leverage causing a lifting action to separate the earring from the card, said apparatus with pronged mechanism and associated handle allowing the user to control load force and effort force as said leverage is applied;

a cover in association with the pronged mechanism for preventing the ornamental portion of the earring from flipping away as it is removed from the card;

a cover attachment means for attaching the cover to the pronged mechanism; and a cup means for catching and containing the earring retainer.

2. An apparatus as claimed in claim 1 further comprising a connector means for connecting the pronged mechanism, the associated handle, the cover, the cover attachment means, and the cup means into an integrated unit.

3. An apparatus as claimed in claim 2 further comprising an extension means extending from the cup means outward toward the connector means to associate the cup means with the connector means.

4. An apparatus as claimed in claim 3 wherein the apparatus and all associated means has a length measuring less than 12 centimeters.

5. An apparatus for protecting fingernails and manicures when removing earrings from a purchase display card, said apparatus being comparable in efficacy to one's fingernails, the earrings including an ornamental portion with a predeterminedly narrow post extending therefrom, and an earring retainer of a size smaller than an earlobe insertable on the post to hold the earring to the card when the post extends through the card, the card being situated between the ornamental portion and the earring retainer, the apparatus comprising:

a pronged mechanism wherein the prongs are sufficiently near in proximity, one to another, so as to slide between the earring and the card;

a handle associated with the pronged mechanism for a user to apply leverage to the pronged mechanism to exert a lifting action to separate the earring from the card, allowing said user to maintain control over the diminutive parts of the earring while using the apparatus;

a cover in association with the pronged mechanism for preventing the ornamental portion of the earring from flipping away as leverage is applied to remove the earring from the card, wherein the pronged mechanism, handle, and cover, have a length measuring less than 12 centimeters, wherein the cover further comprises cover attachment means for attaching the cover to the pronged mechanism; and a cup means for catching and containing the earring retainer.

6. An apparatus as claimed in claim 5 further comprising a connector means for connecting the pronged mechanism, the associated handle, the cover, and the cup means into an integrated unit.

7. An apparatus as claimed in claim 5 wherein the pronged mechanism comprises associated prongs defining a space measuring less than 0.5 centimeters prior to convergence of said associated prongs.

8. An apparatus for removing earrings from a purchase display card while protecting ones fingernails and manicure, as well as protecting ornamental features of the earrings, by replacing the use of one's fingernails to remove the earrings, said earrings including an ornamental portion with a narrow post extending therefrom, and a diminutive earring retainer insertable on the narrow post to hold the earring to the card, the earring retainer of a diminutive size so as to serve its main purpose of situating discreetly behind one's earlobe to clasp said earring to one's ear, the card being situated between the ornamental portion and the earring retainer with said narrow post extending through said card, the apparatus comprising:

a pronged mechanism wherein associated prongs define a space measuring less than 0.5 centimeters prior to convergence of said associated prongs so as to slide between the earring and the card;

an associated handle for a user to apply leverage to the pronged mechanism to separate the earring from the card, said apparatus with pronged mechanism and associated handle allowing said user to exert control of non-excessive load force and effort force as said leverage is applied; and a cup means for catching and containing the earring retainer when the earring is removed from the card.

9. An apparatus as claimed in claim 8 further comprising a cover in association with the pronged mechanism for preventing the ornamental portion of the earring from flipping away as it is removed from the card.

10. An apparatus as claimed in claim 9 wherein the cover further comprises cover attachment means for attaching the cover to the pronged mechanism.

11. An apparatus as claimed in claim 10 further comprising a connector means for connecting the pronged mechanism, the associated handle, the cover, the cover attachment means, and the cup means into an integrated unit, said integrated unit having a length measuring less than 12 centimeters.

* * * * *